United States Patent [19]

Gwo-Jiang

[11] Patent Number: 4,986,106

[45] Date of Patent: Jan. 22, 1991

[54] MULTIPURPOSE CRIMPER FOR CABLE CONNECTION

[76] Inventor: Liaw Gwo-Jiang, No. 1, Alley 78, Lane 113, Sec. 2, Chung Shan Rd, Shu Lin Tsen, Taipei, Taiwan

[21] Appl. No.: 414,544

[22] Filed: Sep. 29, 1989

[51] Int. Cl.[5] ..... H01R 43/042

[52] U.S. Cl. ..... 72/410; 29/751; 81/355; 7/107

[58] Field of Search ..... 72/410, 409, 412, 416; 29/751; 81/355, 361, 128, 126; 7/107

[56] References Cited

U.S. PATENT DOCUMENTS

| | | | |
|---|---|---|---|
| 2,914,976 | 12/1959 | Demler | 81/355 |
| 3,807,930 | 4/1974 | Steidel | 72/409 |
| 4,713,874 | 12/1987 | Schwartz | 7/107 |
| 4,862,580 | 9/1989 | Wang | 29/751 |

FOREIGN PATENT DOCUMENTS

| | | | |
|---|---|---|---|
| 679919 | 2/1964 | Canada | 72/410 |

*Primary Examiner*—Daniel C. Crane

*Attorney, Agent, or Firm*—Lowe, Price, LeBlanc, Becker & Shur

[57] ABSTRACT

The present invention relates to a multipurpose crimp for cable connection and more particularly the one which is comprised of a pair of opposite handle portions, a pair of opposite cable stripper blades, a shearing cutter, a bottom block, a fixed crimper, a movable die, and movable crimper, a cover plate, and a pair of springs. When the two opposite handle portions are squeezed inward, the cable stripper blades, the shearing cutter, the movable crimper and the movable are concomitantly driven to move for respectively performing cable stripping, cutting or crimping process.

3 Claims, 2 Drawing Sheets

MULTIPURPOSE CRIMPER FOR CABLE CONNECTION

BACKGROUND OF THE INVENTION

Conventional crimper is specifically designed to crimp cable adapter for cable connection, which is normally suitable for one specific size of cable adapter and is not practical to serve as a cable cutter or cable stripper. Therefore, in an operation to connect two cables, one may have to prepare several hand tools including cable stripper, cutter, crimper or some other similar tools. It is indeed very inconvenient and expensive to prepare a variety of hand tools to perform wiring process.

The main feature of the present invention is that the crimper is comprising slots conveniently for crimping cables in size of 4P, 6P and 8P without changing any component parts.

Another feature of the present invention is that the crimping, stripping as well as cutting process are collectively performed by a single crimper; through the operation to press on the handle portions, the cable stripper blades may be driven to perform cable stripping process, the shearing cutter may be driven to perform cable cutting process, and the movable crimper the fixed crimper and the movable die are driven to perform cable crimping process.

SUMMARY OF THE INVENTION

According to the present invention, a multipurpose crimper is generally comprised of a pair of opposite handle portions including a left-handed handle portion and a right-handed handle portion, a pair of opposite cable stripper blades including a first cable stripper blade and a second cable stripper blade, a shearing cutter, a bottom block, a fixed crimper, a movable die movable crimper a cover plate, and a pair of springs, wherein the bottom block comprises a trough at the rear end for receiving the fixed crimper another trough in the middle for receiving the movable die and the movable crimper a base for mounting thereon of the first cable stripper blade, two holes onto which a cushion, a pair of washers and the two opposite handle portions are respectively mounted; the pair of springs are respectively set between the movable die and the fixed and movable crimpers; the cover plate covers over the bottom block to let the two opposite handle portions be firmly retained therebetween; the second cable stripper blade is fixedly mounted on the left handle portion, and the shearing cutter is fixedly connected to the right-handed handle portion at the bottom. When the two opposite handle portions are squeezed inward, the cable stripper blades, the shearing cutter, the movable crimper and the movable die are concomitantly driven to move for respectively performing cable stripping, cutting or crimping process.

The above and other objects, features and advantages of the present invention will be fully understood from the following detailed description of the preferred embodiment considered in connection with the annexed drawings in which:

DETAILED DESCRIPTION OF THE PREFERRED EMBODIMENT

Figure 1:
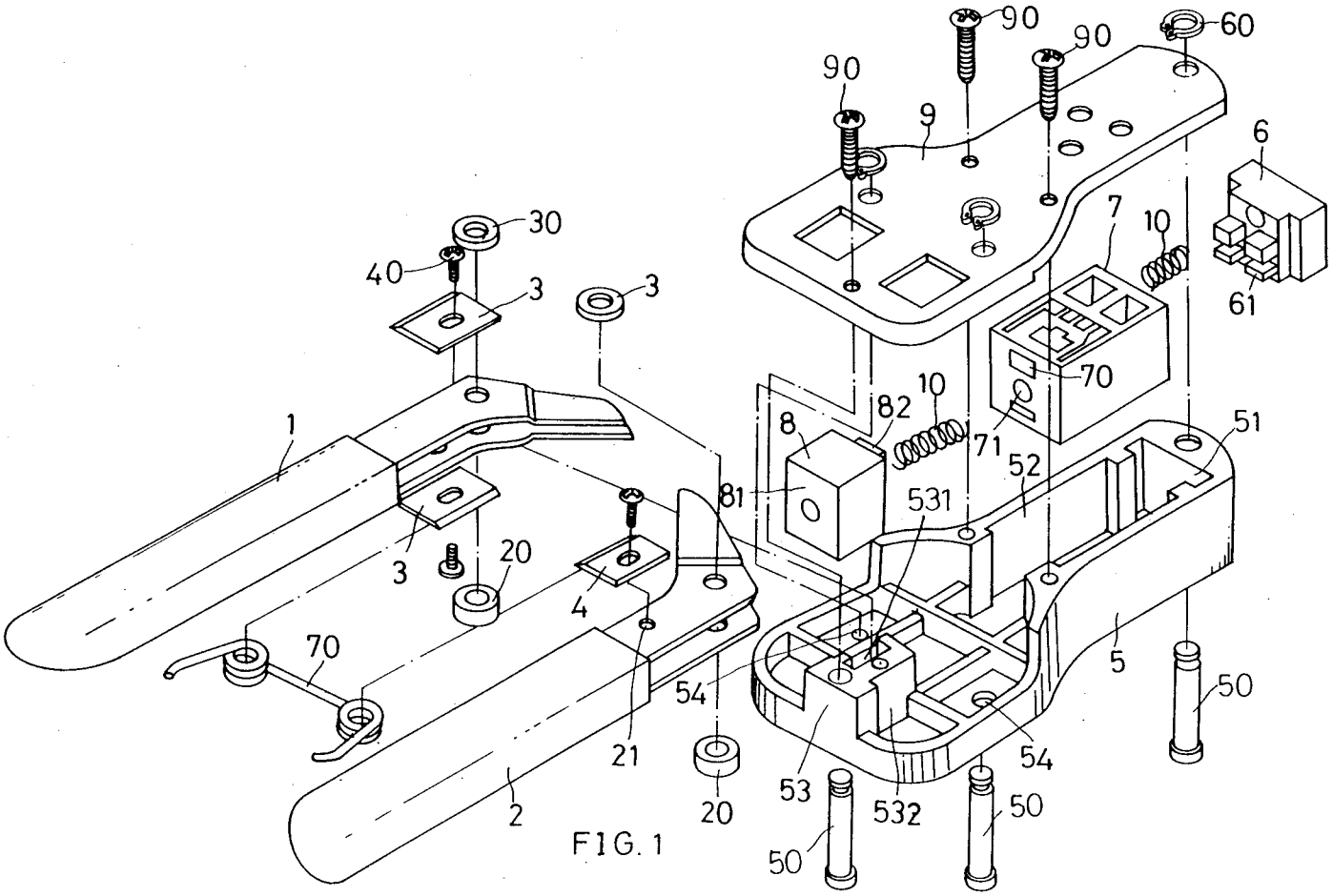
FIG. 1 is a perspective exploded view of the present invention.
Figure 2:
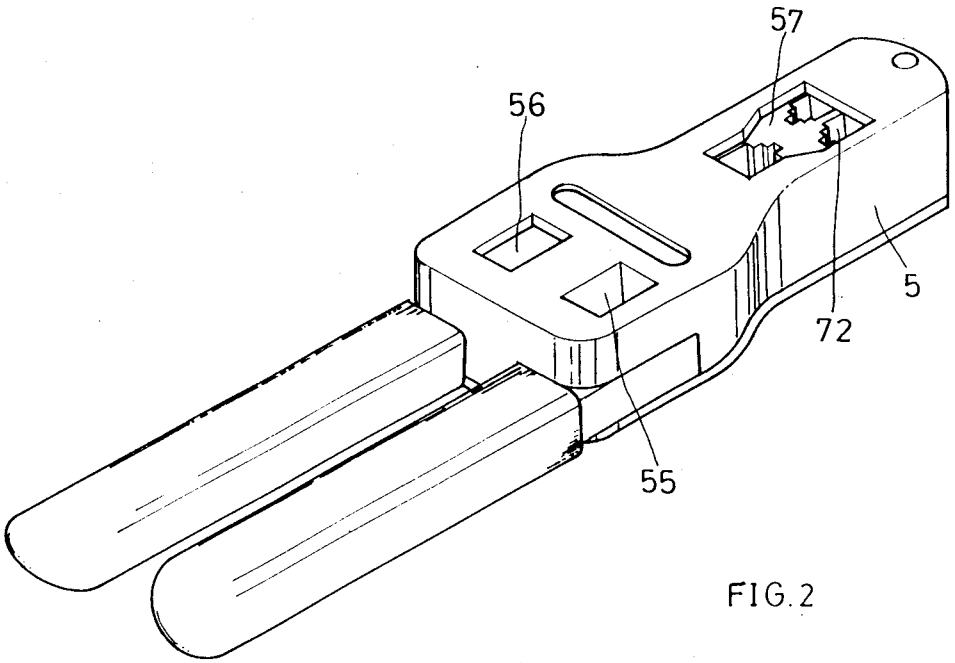
FIG. 2 is a perspective assembly view of a multipurpose crimper embodying the present invention.

Turning now to the attached drawing in detail, therein illustrated is a multipurpose crimper embodying the present invention and generally comprised of a pair of opposite handle portions (1) and (2), a pair of opposite cable stripper blades (3) and (3)', a shearing cutter (4), a bottom block (5), a fixed crimper (6), a movable die (7), and movable crimper (8), a cover plate (9), and a plurality of springs (10), wherein the bottom block (5) comprises a trough (51) at the rear end for receiving the fixed crimper (6), another trough (52) in the middle for receiving the movable die (7) and the movable crimper (8), a base (53) integrally set at the front end having recess (531) with a hole made thereon for insertion therethrough of a screw means (40) to fix the cable stripper blade (3) onto the base (53), two holes (54) onto which a cushion (20), two opposite handle portions (1), (2) and the pair of wasners (30) are respectively mounted; a spring (10) is respectively set between the movable die (7) and the fixed and movable crimpers (6) and (8) having one end stopped against the fixed crimper (6) or the movable crimper (8) and the other end inserted into the hole (71) of the movable die (7); the cover plate (9) covers over the bottom block (5) to become fixedly connected thereto by means of three lock pins (50) C-shaped retainer rings (60) and screws (90) with the two opposite handle portions (1) and (2) firmly retained therebetween; the cable stripper blade (3) is fixedly connected to the left handle portion (1) at the bottom by means of another screw means (40); the shearing cutter (4) is fixedly mounted on the hole (21) of the right handle portion (2) at the top by means of a screw means (40); and a spring means (70) is set between the two opposite handle portions (1) and (2) at the inner side to constantly push the two oppostite handle portions (1) and (2) return to original position.

When in operation to squeeze the two opposite handle portions (1) and (2), the cable stripper blades (3) and (3'), the shearing cutter (4), the movable crimper (8), the movable die (7) and the fixed crimper (6) are concomitantly driven to move for respectively performing cable stripping, cutting or crimping process. When in operation, one may selectively operate to perform either process according to requirement.

With respect to cable stripping process, cable is inserted through the cable stripping slot (55) of the bottom block (5) into the gap between the two cable stripper blades (3) and (3'). As soon as the two opposite handle portions (1) and (2) are relatively squeezed inward, the cable stripper blade (3') on the left handle portion (1) is moved to close to the cable stripper blade (3) on the base (53) for performing cable stripping process.

With respect to cable cutting process, cable is inserted through the cable cutting slot (56) of the bottom block (5) into the gap between the shearing cutter (4) and the side plane (532) of the base (53). As soon as the two opposite handle portions (1) and (2) are relatively squeezed inward, the shearing cutter (4) is immediately driven by the right handle portion (2) to move toward the side plane (532) of the base (5) to cut off the cable With respect to crimping process, a cable which is well connected with a terminal is inserted through the opening (57) for movable die into either one of the crimping slots (72) according to the size of the adapter used. As soon as the two opposite handle portions (1) and (2) are relatively squeezed inward, the front end of the handle portions (1) and (2) pushes against the end surface (81) of the movable crimper (8) as in a cam-follower construction to force the movable crimper (8) and the movable die (7) move forward along the middle trough (52) to become closely in contact with the fixed crimper (9). When the two crimpers (6) and (8) are closely connected with the movable die (7), the dowels (61) and (82) of the two crimpers (6) and (8) are respectively inserted into the slots (73) of the frame to squeeze the cable adapter set therein, so as to achieve crimping process to let cable and adapter be firmly connected.

I claim:

1. A multipurpose crimper having a pair of handle portions including a left-handed handle portion and a right-handed handle portion, a pair of cable stripper blades including a first cable stripper blade and a second cable stripper blade, a shearing cutter, a bottom block, a fixed crimper having dowels, a movable die, and movable crimper having dowels, a cover plate, and a pair of springs, wherein said bottom block comprises a trough at the rear end receiving said fixed crimper, another trough in the middle receiving said movable die and said movable crimper so that said fixed crimper, movable die and movable crimper are all arranged in tandem, a base mounted thereon said first cable stripper blade, two holes onto which a cushion, a pair of washers and said two opposite handle portions are respectively pivotally mounted, said handles each having ends for engaging said movable crimper in a cam-follower arrangement; said pair of springs being respectively set between said movable die and said fixed and movable crimpers; said cover plate covering said bottom block to firmly retain said two handle portions therebetween; said second cable stripper blade being mounted on said left handle portion; said shearing cutter being fixedly connected to said right-handed handle portion at the bottom;

characterized in that when said two opposite handle portions are squeezed inward, said first cable stripper blade is driven toward said second cable stripper blade for cable stripping; said shearing cutter on said right-handed handle portion moves toward said base to cut a cable; and said movable crimper and said movable die are pushed toward said fixed crimper by the ends of said handle retained between said cover and block so that the dowels of said movable and fixed crimpers respectively are inserted into said movable die to perform crimping process.

2. The multipurpose crimper according to claim 1, wherein said pair of springs are respectively set between said movable die said fixed and movable crimpers with one end stopped against said fixed or movable crimpers and with the other end inserted into said movable die.

3. The multipurpose crimper according to claim 1, wherein said movable die has cable adaptor slots made thereon respectively for receiving cable adapters of predetermined sizes.

* * * * *